US010646012B2

(12) United States Patent
Heim

(10) Patent No.: US 10,646,012 B2
(45) Date of Patent: May 12, 2020

(54) POLE HAVING A TIP SPRING MECHANISM

(71) Applicant: LEKISPORT AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 197 days.

(21) Appl. No.: 15/545,098

(22) PCT Filed: Jan. 28, 2016

(86) PCT No.: PCT/EP2016/051848
§ 371 (c)(1),
(2) Date: Jul. 20, 2017

(87) PCT Pub. No.: WO2016/128229
PCT Pub. Date: Aug. 18, 2016

(65) Prior Publication Data

US 2018/0008021 A1 Jan. 11, 2018

(30) Foreign Application Priority Data

Mar. 17, 2015 (CH) ..... 364/15

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/0288* (2013.01); *A45B 2200/055* (2013.01); *A61H 2003/0283* (2013.01)

(58) Field of Classification Search
CPC ..... A61H 3/0277; A61H 2003/0283; A61H 3/0288; A45B 9/04; A45B 2200/05; A45B 2200/055
See application file for complete search history.

(56) References Cited

U.S. PATENT DOCUMENTS 2,397,499 A * 4/1946 McGowan ..... A61H 3/0277 135/82
2,398,534 A * 4/1946 Klausnitzer ..... A61H 3/0277 135/82

(Continued)

FOREIGN PATENT DOCUMENTS

DE 79 22 100 U1 11/1979
DE 10 2005 028 914 A1 1/2007

(Continued)

OTHER PUBLICATIONS

International Search Report of PCT/EP2016/051848, dated Mar. 30, 2016. [PCT/ISA/210].

(Continued)

*Primary Examiner* — David R Dunn
*Assistant Examiner* — Danielle Jackson
(74) *Attorney, Agent, or Firm* — Sughrue Mion, PLLC

(57) ABSTRACT

The invention relates to a pole, such as a Nordic walking pole, at the lower free end of which a tip body is provided, which has an end attachment, which is closed at the bottom and which has a central accommodating opening for accommodating a bottommost tube segment of the pole body. Furthermore, the tip body has an outer circumferential elastic elastomer spring element, which is connected axially above an upper end of the end attachment and which reaches around the bottommost tube segment of the pole body or a middle axial segment of the insertion element at least partially in the circumferential direction and which damps an axial relative motion of the bottommost tube segment of the pole body and/or of the insertion element in relation to the end attachment when an axial force is applied.

27 Claims, 7 Drawing Sheets

(56) References Cited

U.S. PATENT DOCUMENTS

| | | | | |
|---|---|---|---|---|
| 2,690,188 | A * | 9/1954 | Goddard | A61H 3/02 135/72 |
| 4,061,347 | A | 12/1977 | Stern et al. | |
| 6,216,713 | B1 | 4/2001 | Kennan | |
| 8,820,339 | B2 | 9/2014 | Goodwin | |
| 2011/0073146 | A1 | 3/2011 | Miller | |

FOREIGN PATENT DOCUMENTS

| | | | |
|---|---|---|---|
| EP | 0 820 711 | A1 | 1/1998 |
| EP | 1 814 419 | A1 | 8/2007 |
| EP | 2 381 812 | A1 | 11/2011 |
| WO | 87/004920 | A1 | 8/1987 |
| WO | 88/006876 | A1 | 9/1988 |
| WO | 2006/047803 | A1 | 5/2006 |
| WO | 2008/061103 | A2 | 5/2008 |
| WO | 2010/085905 | A1 | 8/2010 |

OTHER PUBLICATIONS

International Preliminary Report on Patentability and Written Opinion, dated Aug. 24, 2017, from the International Bureau in counterpart International application No. PCT/EP2016/051848.

* cited by examiner

POLE HAVING A TIP SPRING MECHANISM

CROSS REFERENCE TO RELATED APPLICATIONS

This application is a National Stage of International Application No. PCT/EP2016/051848 filed Jan. 28, 2016, claiming priorities to Swiss Patent Application Nos. 00199/15, filed Feb. 13, 2015, and 00364/15, filed Mar. 17, 2015, the contents of all of which are incorporated by reference herein in their entirety.

TECHNICAL SCOPE

The present invention relates to a tip body for a pole, in particular a Nordic walking pole, trekking pole, ski pole, cross-country ski pole or walking pole, having a spring mechanism for the purposes of damping the exertion of axial force produced by the supporting movement of the user; as well as to a pole with such a tip body.

PRIOR ART

The majority of poles from the prior art comprise a damping device in the interior of the pole, in the majority of cases in the form of a compression coil spring. This is usually positioned in the upper pole region, e.g. in the vicinity of the handle, or between two telescopic pole portions, such as, e.g. in U.S. Pat. No. 4,061,347. EP 1 814 419 and DE 10 2005 028 914, for example, certainly each disclose a damping device in the lower pole region, however in each case also in the form of an inner spring mechanism by means of compression coil springs. When using an external clamping system, such as, for example, in EP 2 381 812, however, the installation of an inner damping device gives rise to problems as it would obstruct the telescopic function. U.S. Pat. No. 8,820,339 discloses a bellows which acts as a damping device as a possible solution in the case of external clamping. EP 0 820 711 discloses an external damping device which is fixed on the pole body by means of a bracket.

SUMMARY OF THE INVENTION

The object accordingly underlying the invention is, amongst other things, to propose an improved damping device, which is simple to produce and is resistant to contamination, for a telescopic pole, in particular, for example, for a telescopic pole with an external clamping system, the damping device having to be simple to produce and being realized in as narrow a manner as possible, i.e. with regard to both axial and circumferential extension. Tip damping is particularly advantageous on a pole which comprises, for example, at least two tube portions which can be telescoped into one another (e.g. trekking pole) and which comprises an external clamping system for length adjustment or for detachably fixing the relative axial position of the at least two telescopic tube portions with respect to one another. The design, however, can be used in the same way with telescopic systems with internal clamping or with internal and external clamping.

The solution to said object is achieved in that a pole, in particular a Nordic walking pole, trekking pole, ski pole, cross-country ski pole or walking pole, is made available which comprises a pole body, on the lower free end of which a tip body is provided. The tip body comprises a downwardly closed end attachment with a central receiving opening. Said central receiving opening serves for receiving a lowermost tube portion of the pole body. In addition to this or as an alternative to it, the central receiving opening can serve for receiving an insertion element which is received and fastened in the lowermost tube portion of the pole body by way of an upper axial portion, and is received in the central receiving opening of the end attachment by way of a lowermost axial portion. The insertion element serves in this case to a certain extent as a connecting member between the lowermost tube portion and the end attachment.

A further damping element, e.g. a disk produced from elastic material, can be provided, in this case, as stop damping at the bottom of the blind hole of the end attachment. As an alternative to this, a further such damping element can also be arranged and fastened on and/or in the element impacting on said bottom.

The tip body further comprises an outer circumferential elastic elastomer spring element which connects axially above an upper end of the end attachment and engages around the lowermost tube portion of the pole body or—according to the above-named alternative—a middle axial portion of the insertion element at least in part in the circumferential direction. An elastomer spring element is to be understood as an element which provides a highly elastically deformable body, and both cushions and damps, e.g. in the form of a foam spring (e.g. PU) or an elastic full body, here in each case with a central passage opening. Said elastomer spring element damps and cushions an axial relative movement of the lowermost tube portion of the pole body relative to the end attachment and/or of the insertion element whilst an axial force is applied from above onto the pole. In this case, the lowermost tube portion of the pole body or, where applicable, also the insertion element, is mounted so as to be displaceable in the central receiving opening of the end attachment counter a spring force of the elastic spring element axially. The elastomer spring element, when it is designated as an outer circumferential, elastic, elastomer spring element, is an element, which, in a preferred manner, is substantially hollow-cylindrical (where applicable with a structured surface and end regions) produced from elastomer material, the outside surface of which forms the outside surface of the tip body. In other words, it completely surrounds the other components of the tip body on the outside in a circumferential manner in a certain axial portion. Different types of thermoplastic elastomer materials are used as material for the elastomer spring element, e.g. TPE-O, i.e. polyolefin blends, e.g. PP/EPDM, e.g. Santoprene (AES/Monsanto); TPE-V, i.e. crosslinked polyolefin blends, e.g. PP/EPDM, e.g. Sarlink, Forprene, TPE-U i.e. urethane blends, e.g. Elastollan (BASF) or Desmopan, Texin, Utechllan (Bayer); TPE-E, i.e. thermoplastic polyester elastomers/thermoplastic copolyester, e.g. Keyflex (LG Chem); TPE-S i.e. Styrene block copolymers (SBS, SEBS, SEPS, SEEPS and MBS), e.g. Styroflex (BASF), Septon (Kuraray), Thermolast (Kraiburg TPE) or Saxomer (Polyplast Compound Werk GmbH), TPE-A, i.e. thermoplastic Copolyamide, e.g. PEBAX (Arkema). In this case, attention must be paid to temperature tolerance (hot and cold) and injectability.

In a preferred embodiment, the tip body further comprises an upper stop element which is fastened in a preferred manner on a shoulder on the lowermost tube portion of the pole body, or on the lower end of the upper axial portion of the insertion element and provides an upper stop for the elastomer spring element. In this case, the elastomer spring element is arranged axially between a lower stop, which is arranged on the upper end of the end attachment, and the upper stop. The elastomer spring element is preferably fastened on the upper and/or lower stop by means of a positive locking connection, in particular a tongue and groove connection, such as, for example, a dovetail connection, and/or as an alternative to this or in addition to it, by means of a materially-bonded connection, in particular an adhesive connection or weld connection, or can also be fused-on or injected-on, or fitted-over as a sleeve. The upper stop and/or the lower stop for the elastomer spring element can also be realized in each case as an alternative to this as a level surface which extends in the radial direction on the upper stop element or on the upper end of the end attachment and is supported substantially parallel to a support base on which the pole is supported by the user. The connection to the adjacent surface can then be achieved, for example, as a result of a bonded connection, weld connection or can also be fused-on or injected-on. The end attachment, the elastic element and the upper stop element are preferably connected together in an integral manner, preferably in a hermetically sealed manner. This can be achieved, for example, as a result of a multi-component injection molding process or can be contact welded.

According to a further advantageous embodiment, additionally arranged on the tip body is a radial transverse pin which penetrates, in a radial manner, the end attachment as well as the lowermost tube portion or the insertion element in a middle portion or a lower portion in a direction transversely to the pole longitudinal axis. A passage opening, which extends from a point in the wall to one located opposite in the circumferential direction in the wall of the end attachment, for the bearing arrangement of the radial transverse pin is arranged in the end attachment. The lowermost tube portion or the lower axial portion of the insertion element comprises at least one axial elongated hole, preferably two elongated holes, which are situated opposite one another in the circumferential direction, in the respective wall for guiding the transverse pin such that the radial transverse pin is mounted so as to be axially displaceable within the boundaries of the at least one axial elongated hole counter the spring force of the elastic element when an axial force acts from above onto the pole body. The elongated hole preferably has a length of between 0.5 and 3 cm, particularly preferred between 0.7 and 1.5 cm and preferred most of all between 0.8 and 1.3 cm. The guiding of a transverse pin also enables rotational stability, or anti-rotation protection of the parts which are axially displaceable with respect to one another. As a result of installing the guiding of the spring mechanism in the interior of the tip body, the damping system is less susceptible to contamination or corrosion produced by the effects of weather. In an advantageous manner, the transverse pin can be arranged below the plate sleeve, it is then captive, trapped and hermetically closed, no contamination is able to enter it.

The non-elastic elements of the body can consist of materials such as polyamide, e.g. PA66.

The end attachment advantageously comprises an axial length of between 3 and 15 cm, preferably between 5 and 12 cm, in particular preferred between 7 and 10 cm. In addition to this or as an alternative to it, the insertion element advantageously comprises an axial length of between 2 and 12 cm, preferably between 3 and 10 cm, in particular preferred between 5 and 8 cm. The insertion element is preferably produced from aluminum, as an alternative to this from other metals, plastics material or a metal-plastics material connection. In the case of plastics materials, above all fiber-reinforced plastics materials are advantageous.

According to a preferred embodiment, the elastomer spring element comprises an axial length of within the range of between 0.5 and 4 cm, preferably between 1 and 3 cm, in particular preferred between 1.5 and 2 cm, and advantageously a radial thickness (measured from the outside wall of the engaged-around region of the tube portion or of the insertion element up to the periphery) of within the range of between 0.2 and 1 cm, preferably between 0.4 and 0.8 cm, in particular preferred between 0.5 and 0.7 cm.

According to a further preferred embodiment, the lowermost tube portion comprises a shoulder, at which the lowermost tube portion tapers axially downward such that the diameter of the lowermost tube portion axially below the shoulder is smaller than the diameter of the lowermost tube portion axially above the shoulder, wherein the shoulder serves as an upper stop for the tip body.

The end attachment is preferably realized in a closed manner at a free end facing a support base. This can be achieved either by realizing the central receiving opening as a blind hole or by admitting a pin serving as pole tip, preferably an insert with a hard metal tip or a hard metal pin, from below at an end of the end attachment facing a support base, and preferably fastening it in the central receiving opening of the end attachment. As an alternative to this or in addition to it, a buffer or a pole plate can be fastened on the end attachment, wherein in the case of a pole plate being fastened on a pole, the pole plate preferably engages around a region of the end attachment in which the radial transverse pin projects through the central receiving opening. In this way, the passage opening can be protected from contamination and the pin can be secured against unintentional loss as a result of being engaged around. Such a pole plate can be held on the end attachment within defined boundaries, for example between two continuations on the periphery of the end attachment, e.g. by a lower stop on a circumferential thickening and by an upper stop on a shoulder.

The upper and/or the lower axial portion of the insertion element is preferably realized in a substantially cylindrical manner, wherein the upper axial portion of the insertion element preferably comprises a peripheral structuring, preferably in the form of radial recesses, in particular preferred in the form of radial, for example ring-shaped incisions which are spaced apart from one another axially and are circumferential at least in part. According to a further preferred embodiment, the outside diameter of the upper axial portion of the insertion element is greater than the outside diameter of the middle axial portion and/or than the outside diameter of the lower axial portion of the insertion element. This is in particular the case when the lowermost tube portion is not realized in a conified manner, but comprises a uniform diameter in the lowermost region. In this case, the lower end of the lowermost tube portion then preferably rests on a circumferential flange at the lower end of the upper portion of the insertion element. The insertion element, in turn, then preferably rests by way of a shoulder on the upper stop element of the tip body. The lower end of the lowermost tube portion can, however, also extend up to the shoulder of the insertion element or up to the lower end of the upper portion of the insertion element, in this case both lower ends resting on the upper stop element. The middle and lower portion of the insertion element preferably project into the central receiving opening of the tip body which, in said embodiment, comprises a smaller diameter than the cavity of the lowermost tube portion.

An alternative preferred embodiment comprises an upper axial portion of the insertion element, the diameter of which is smaller than the lower axial portion of the insertion element (absolutely no middle portion being present in said embodiment with a shortened insertion element) such that the upper portion of the insertion element is received in the interior of the lowermost tube portion, and said lowermost tube portion is received in turn in the interior of the end attachment. A shoulder, which serves as a lower stop for the lower end of the lowermost tube portion, is arranged between the upper axial portion of the insertion element and the lower axial portion of the insertion element, or the lower end of the lowermost tube portion rests on said shoulder. The lower axial portion of the insertion element, in this case, abuts against the inside wall of the end attachment. In said embodiment, the insertion element is therefore received completely in the central receiving opening of the end attachment, or does not project axially beyond the tip body.

The lower axial portion of the insertion element comprises, in the case of embodiments where such an insertion element is present, a diameter which corresponds substantially to the inside diameter of the end attachment in the central receiving opening such that the insertion element, which is guided inside the end attachment, preferably by means of a friction-locking connection, slides axially in the end attachment when an axial force is applied from above onto the pole body. The sliding is achieved as soon as the acting force exceeds the spring force of the elastomer spring element.

In an advantageous manner, the blind hole bore in the end attachment in which the insertion element slides is arranged such that ejection out of the elongated hole when the pole is fully deflected is prevented.

A further preferred embodiment of the proposed pole body can be characterized in that a further damping element is provided in the central receiving opening of the end attachment. Said damping element damps the situation where either the lowermost tube portion or the insertion element comes into contact with the bottom of the blind hole in the end attachment. Thus, when the elastomer spring element is not able or not meant to cushion the movement fully, a hard non-cushioned impact on the lower stop is prevented.

Said damping element can be inserted into the central receiving opening of the end element or rather can be fastened therein as a separate element. It is also possible to fasten the damping element on the lower end of the tube portion or rather of the insertion element, or it is also possible to realize the lowermost end of the insertion element as such a damping element, for example by realizing the insertion element as a two-component part, and realizing the region thereof facing the bottom of the blind hole from elastomer material. Another option to design the mounting in a particularly simple manner can consist in developing the additional damping element with a guide journal which can then be inserted into the typically present central recess of the lowermost tube portion or of the insertion element and fastened therein.

Such a, as a rule, circular cylindrical damping element has typically an axial length of between 2 and 7 cm, preferably within the range of between 3 and 5 cm, and an outside diameter which is designed to be somewhat smaller or the same size as the inside diameter of the central receiving opening in the corresponding region. The damping element can be realized from the same materials as the elastomer spring element.

The technical object of the subject matter is additionally achieved by the provision of a tip body for a pole, in particular for a Nordic walking pole, trekking pole, ski pole, cross-country ski pole or walking pole. It can then be fitted in an interchangeable manner onto the lowermost pole tube portion of a pole and fastened thereon.

Such a tip body according to the invention comprises a downwardly closed end attachment with a central receiving opening for receiving a lowermost tube portion of a pole body and/or for receiving an insertion element which is received by way of an upper axial portion in the lowermost tube portion of the pole body and by way of a lower axial portion in the central receiving opening of the end attachment.

The tip body additionally comprises an outer circumferential, elastic elastomer spring element which connects axially above an upper end of the end attachment and engages around the lowermost tube portion of the pole body or a middle axial portion of the insertion element in the circumferential direction, and damps an axial relative movement of the lowermost tube portion of the pole body when an axial force is applied. The elastomer spring element is preferably realized to a certain extent as an elastic ring.

The tip body preferably additionally comprises an upper stop element, which is fastened in a preferred manner on a shoulder on the lowermost tube portion of the pole body or on the lower end of the upper axial portion of the insertion element, engages around the same in the circumferential direction just as the elastomer spring element and provides an upper stop for the elastomer spring element. Consequently, the elastomer spring element is arranged axially between a lower stop, which is arranged on the upper end of the end attachment, and the upper stop. When the tip body according to the invention is mounted on a pole, the lowermost tube portion of the pole body, or where applicable the insertion element, is mounted so as to be displaceable axially in the end attachment counter a spring force of the elastomer spring element when an axial force is applied from above onto the pole body.

The tip body can accordingly be separately produced and mounted on the pole subsequently, for the purposes of simpler assembly or simple exchange on the pole, if a tip spring mechanism subject to wear has to be replaced. All the embodiments, but in particular the third and fourth embodiments, are suitable for replacement or for subsequent installation on conventional poles as a conified lowermost tube portion is not necessary here. In principle, other designs or tip variants are also conceivable.

Further exemplary embodiments are described in the dependent claims.

BRIEF DESCRIPTION OF THE DRAWINGS

Preferred embodiments of the invention are described below by way of the drawings which simply serve for explanation and are not to be seen as restricting, in which drawings.

DESCRIPTION OF PREFERRED EMBODIMENTS

Figure 1A:
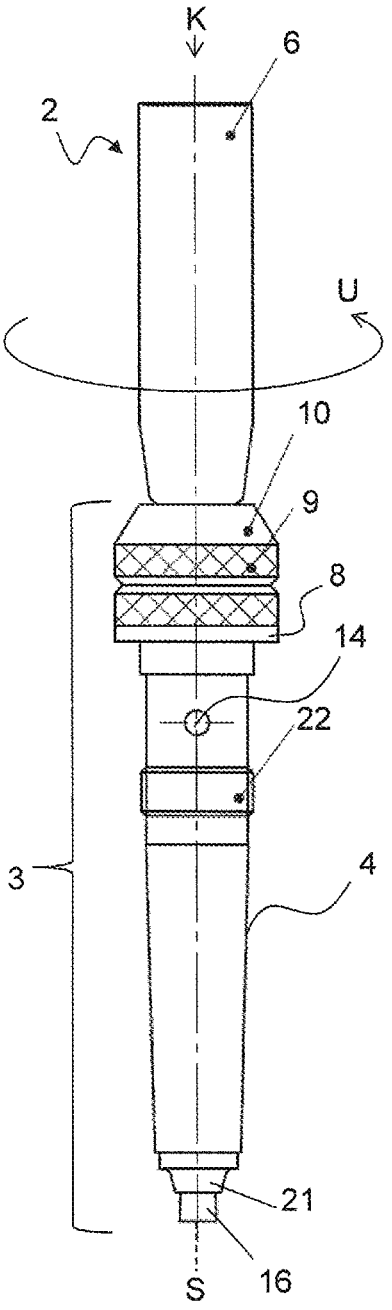
FIG. 1*a* showing a view from the front and FIG. 1*b* an axial section transversely to the direction of extension (Q) of the transverse pin.
Figure 1B:
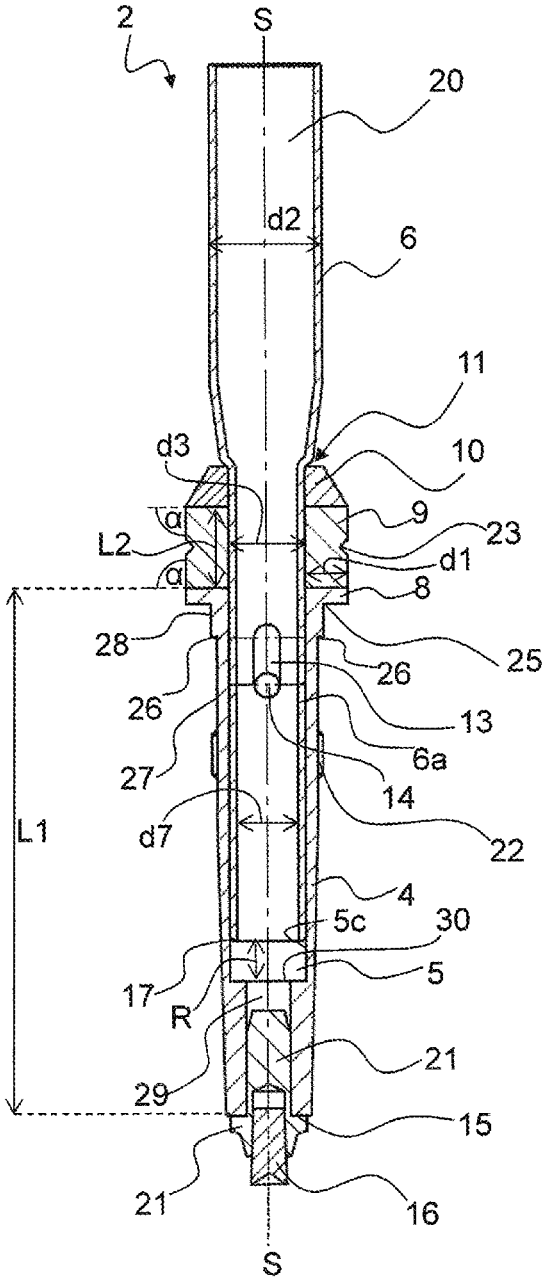
FIG. 1 shows a schematic representation of a lowermost pole tube portion with a tip body fitted from below according to a first preferred embodiment.

The preferred exemplary embodiment shown in FIG. 1 shows a variant of a tip spring mechanism which is structurally very simple. In this case, the lowermost pole tube portion 6 is realized in a conified manner, i.e. it comprises a shoulder 11, the outside diameter d2 of the lowermost tube portion 6 above the shoulder 11 being greater than the outside diameter d3 of the lowermost tube portion 6 below the shoulder 11. Said shoulder 11 forms the upper stop for an upper stop element 10 for the tip body 3. The tip body 3 is formed substantially from three main elements, namely, when viewed from bottom to top in the axial direction, the end attachment 4, the elastomer spring element 9 and the upper stop element 10. All the main elements comprise one receiving opening each (5*a*, 5*b*, 5*c*), which are coaxial to one another, for the receiving of the lower portion 6*a* of the lowermost tube portion 6. The tip body 3 therefore to a certain extent engages around the lower portion 6*a* of the lowermost tube portion 6 by way of its three main elements. The upper stop element is shown in a trapezoidal manner in the sectional representation in FIG. 1*b*, it being a stop ring which comprises an outside surface or flank which slopes radially inward and upward at its periphery. The lower flat surface of the upper stop element 10 provides an upper stop 10*a* for the elastomer spring element 9 which connects axially at the bottom to the upper stop element 9, and extends in the present exemplary embodiment of FIG. 1 in the radial direction at an angle of 90 degrees transversely to the pole longitudinal axis S. The inside diameter of the upper stop element 10 corresponds, in this case, substantially to the outside diameter d3 of the engaged-around lower portion 6*a* of the lowermost pole tube portion 6. In this case, the upper stop element 10, and where applicable also the elastomer spring element 9, can be fastened on the pole tube portion by means of a bonded connection. As an alternative to this, a materially bonded connection, hot fusing (ultrasound welding or other methods) are also possible. The elastomer spring element 9, which is realized to a certain extent as a hollow cylinder, is connected downward to the surface 10*a*. The radial thickness d1 of the elastomer spring element 9, in this case, is between 0.5 and 0.7 cm and the axial length of the elastomer spring element 9 is between 1.5 and 2 cm.

In the exemplary embodiment shown in FIGS. 1*a*, 1*b*, the elastomer spring element 9 comprises on its periphery a circumferential radial recess or a ring-shaped, radially inwardly conically tapering incision 23. More such recesses 23 can also be distributed axially on the elastomer spring element 9, which can result in a compression-friendly form, and can also be used to adjust the spring behavior. By way of its lower surface, the elastomer spring element 9 rests on a lower stop 8*a* which is provided by the flat surface on the top surface of the upper end 8 of the end attachment 4. The upper end 8 of the end attachment 4 is realized to a certain extent as a ring-shaped flange which stands out radially beyond the rest of the end attachment 4. A first shoulder 25, which merges into a short region 28 of the end attachment 4 which comprises a smaller outside diameter than the flange or the upper end 8 of the end attachment 4, is realized on the lower surface of the flange. Said short region 28 merges at a second shoulder 26 into a further smaller-diameter region 27, which connects thereto axially at the bottom and extends axially downward to a threaded portion 22. Said threaded portion 22 can serve as fastening means for a pole plate 24 which is as shown in FIG. 4*g*, possibly fitted onto the end attachment 4 or rather is screw-connected by way of a corresponding internal thread, wherein the pole plate 24 would find an upper stop on the above-described second shoulder 26, or would be held between said two boundaries. The threaded portion 22, in this case, can be integrally formed on the end attachment 4 from the outside or can be fastened thereon or can be realized in one piece with the end attachment 4. The elastomer spring element 9 is therefore to a certain extent clamped between an upper stop 10*a* and a lower stop 8. The elastomer spring element can be additionally fastened to the stop surfaces 8*a*, 10*a* by a bonded connection, a materially bonded connection, for example hot joining (for example ultrasound welding) is also possible here as an alternative.

The end attachment 4, which is inserted from below over the lower portion 6*a* of the lowermost tube portion 6, comprises a central receiving opening 5*c*. The lowermost tube portion 6 is axially displaceable in said receiving opening 5*c*, which is designed as a blind hole in the exemplary embodiment shown, when an axial force K is applied from above onto the pole.

The wall of the lower portion 6*a* of the lowermost tube portion 6, which comprises a cavity 20, comprises one milled or punched or lasered axial elongated hole 13 each on two oppositely situated sides. A radial transverse pin 14 is guided therein in a direction Q transversely to the pole longitudinal axis S, said pin being held at its two ends in two oppositely situated passage openings 1 in the wall of the end attachment 4 and extending transversely through the central receiving opening 5*c* of the end attachment 4.

FIG. 1*b* shows the pole in a rest position, i.e. no force K acts from above axially onto the pole, or rather no force which is greater than the spring force or pre-tensioned spring force of the elastomer spring element 9. If said spring force is overcome, the elastomer spring element 9 is compressed between the two stops 8*a*, 10*a* such that it bows radially outward and/or where applicable inward and the axial length L2 of the elastomer spring element 9 is reduced.

In this case, the lower tube portion 6 is displaced downward inside the end attachment 4, and, at the same time, the radial transverse pin 14, which is situated in the rest position on the lower stop of the axial elongated hole 13, migrates just in front of the upper stop position at the upper end of the axial elongated hole 13. The axial movement, i.e. the damping movement of the pole, is consequently dependent on the size and the material and consequently on the spring force of the elastomer spring element 9 and the travel is delimited by the depth of the blind hole 5*c*. The axial length of the elongated hole 14 is sensibly longer than the possible spring travel in order to prevent ejection from the elongated hole when the respective end position is reached.

During the damping movement or the axial relative movement R of the lowermost tube portion 6 in the end attachment 4, the radial transverse pin 14, guided in the axial elongated hole 13, also serves at the same time as guide means for the lowermost tube portion 6 inside the end attachment 4, or rather as anti-rotation protection or as fixing means for the rotation position of the two parts relative to one another.

The lower end 15 of the end attachment 4 comprises a small cavity 29 into which an insert 21 is inserted from below and is fastened on the inside wall of the lower end 15 of the end attachment 4, for example as a result of bonding or pressing. Said insert 21, in the exemplary embodiment shown in FIG. 1*b*, comprises a hard metal tip 16 which is inserted from below and can be pressed or bonded.

As an alternative to this, the cavity 29 can, however, also be connected to the central receiving opening 5*c* of the end attachment 4 such that the central receiving opening 5*c* is designed as a passage opening which extends from the upper end 8 of the end attachment 4 to its lower end 15 and which can only be closed downward by the insert 21 with tip 16 or by a buffer (not shown) which is fastened on the lower end 15.

Figure 2A:
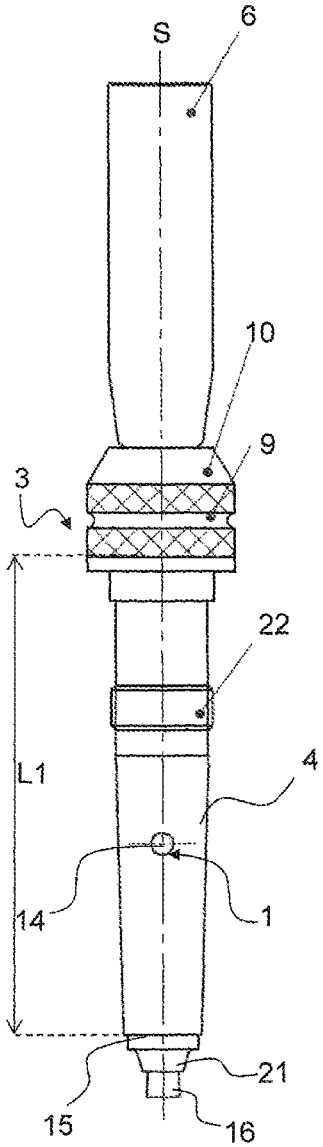
FIG. 2*a* showing a view from the front and FIG. 2*b* an axial section transversely to the direction of extension (Q) of the transverse pin.
Figure 2B:
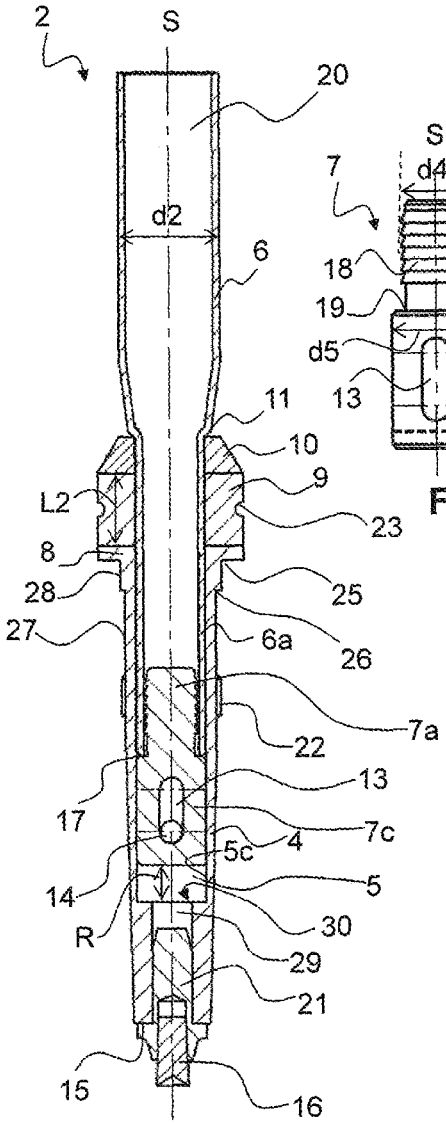
FIG. 2 shows a schematic representation of a lowermost pole tube portion with a tip body fitted from below according to a second preferred embodiment.
FIG. 2*c* showing a schematic representation of the insertion element used in said second preferred embodiment.
FIG. 2*d* showing an axial section through the tip body of FIGS. 2*a*, 2*b* with the three individual elements thereof, FIG. 2*e* showing an enlarged representation of the encircled region Y in FIG. 2*d* in a view rotated by 90 degrees.
Figure 2C:
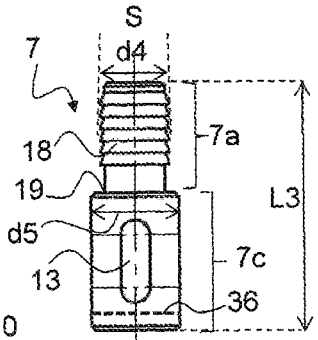

FIG. 2*a* shows a second preferred exemplary embodiment. On the one hand, the peripheral structuring of the elastomer spring element 9 is designed in a somewhat different manner, namely with a ring-shaped circumferential recess which tapers radially inward in a round manner in the middle of the axial length L2 of the elastomer spring element 9. As in the exemplary embodiment in FIG. 1, the lowermost tube portion 6 is realized in a conified manner here too, i.e. it comprises a shoulder 11. According to said second preferred exemplary embodiment, the elongated hole 13, in which is guided the radial transverse pin 14 which is held in the end attachment 4, is not comprised in the lowermost tube portion 6 itself, but rather in an insertion element 7 which is inserted from below into the lower portion 6*a* of the lowermost tube portion 6. The insertion element 7, which is shown in an enlarged manner and on its own in FIG. 2*c*, is produced from aluminum, plastics material, other metal or a combination of said materials. The lower portion 7*c* of the insertion element is realized in a cylindrical manner. The upper portion 7*a* comprises a peripheral structuring 18 in the form of a toothing in order to increase the frictional locking between the insertion element and the lowermost pole tube portion 6. A shoulder 19 is situated between the smaller-diameter upper portion 7*a* with diameter d4 and the larger-diameter lower portion 7*c* with diameter d5. The lower end 17 of the lowermost tube portion 6 rests on said shoulder 19. The upper portion 7*a* projects into the lower portion 6*a* of the lowermost tube portion 6. The insertion element 7 can be bonded additionally in the lowermost tube portion 6 by way of its upper portion 7*a*. The lower portion 7*c* abuts by way of its outside wall against the inside wall of the end attachment 4, and is mounted so as to be axially displaceable therein when an axial force K, which exceeds the spring force of the elastomer spring element 9, is applied from above onto the pole. The insertion element 7 has its lower stop at the lower end 30 of the blind hole 5*c* during the damping movement. In the present exemplary embodiment, the insertion element 7 is realized in a shortened manner, i.e. without a middle portion 7*b*.

Figure 2D:
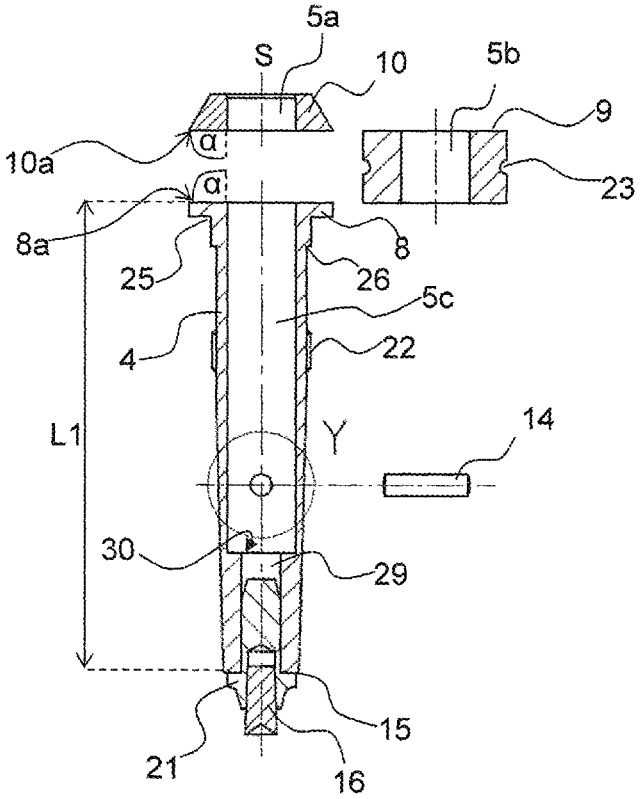

FIG. 2*d* shows a schematic representation of the three individual main elements 4, 9, 10 of the tip body 3 detached from one another. The trapeze form of the upper stop element 10 with its circumferential flank sloping radially inward and upward can be seen here. The two stop surfaces 8*a*, 10*a* extend substantially parallel to the support base at an angle $\alpha$ of 90 degrees to the pole axis S. The trapeze form or the circumferential edge serves for the hermetically sealed connection of the arrangement and can be produced, for example, as a result of injection.

Figure 2E:
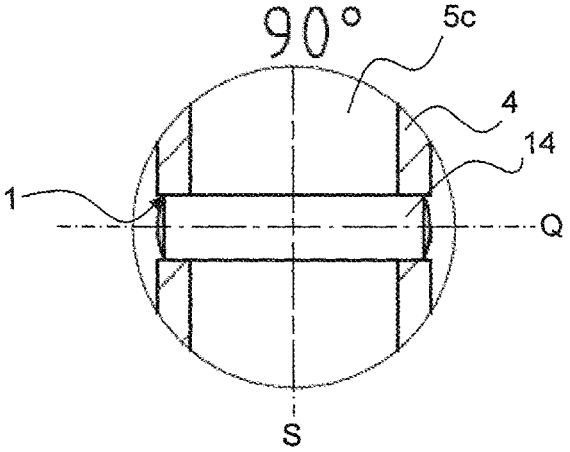

The tip body 3, when it is compressed, comprises a central receiving opening which is composed by the coaxially arranged individual central receiving openings 5*a*, 5*b*, 5*c* of the upper stop element 10, of the elastomer spring element 9 and of the end attachment 4. The central receiving opening 5*c* is designed in all the exemplary embodiments shown in the end attachment 4 as a blind hole, in the case of the elastomer spring element 9 and upper stop element 10, in contrast, as a passage opening 5*b* or rather 5*a*. FIG. 2*e* shows in an enlarged manner the passage openings 1 at the two oppositely situated points of the wall of the end attachment 4 with the radial transverse pin 14 inserted, in a view which is rotated by 90 degrees to the view in FIG. 2*d*.

Figure 3A:
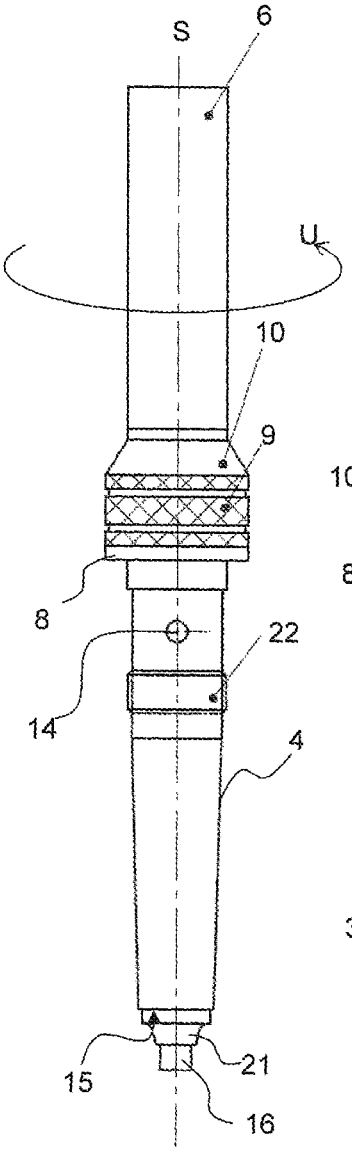
FIG. 3*a* showing a view from the front and FIG. 3*b* an axial section transversely to the direction of extension (Q) of the transverse pin.
Figure 3B:
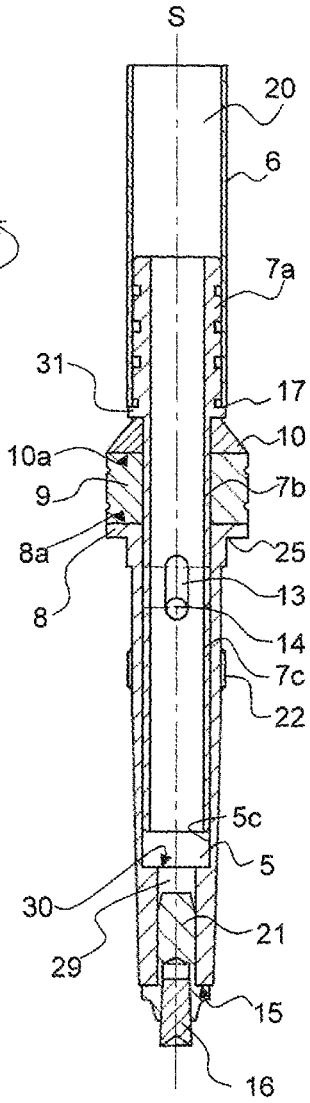
FIG. 3 shows a schematic representation of a lowermost pole tube portion with a tip body fitted from below according to a third preferred embodiment.
FIG. 3*c* showing a schematic representation of the insertion element used in said third preferred embodiment.
Figure 3C:
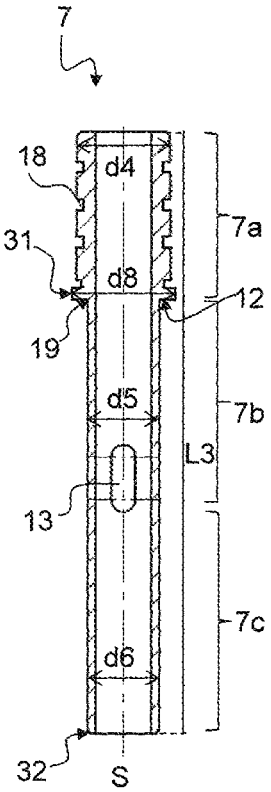

FIG. 3 shows a third preferred exemplary embodiment. In said exemplary embodiment, the lowermost tube portion 6 is not realized in a conified manner. The axial elongated hole 13, however, is integrated once again in a lower portion 7*c* of an insertion element 7. The tube portion 6 is designed in a shorter manner than in the two preceding exemplary embodiments in FIGS. 1 and 2. The lower end 17 of the lowermost tube portion 6 ends above the upper stop element 10 of the tip body 3. When FIG. 3*c*, in which the insertion element 7 of FIG. 3*b* is shown enlarged and on its own, is looked at, it can be seen that the upper portion 7*a* of the insertion element comprises a structuring 18 on its periphery, this being provided by circumferential, ring-shaped incisions which are spaced axially from one another. A circumferential flange 31, the diameter d8 of which is greater than the outside diameter d4 of the remaining part of the upper portion 7*a*, is arranged on the lowermost end 12 of the upper portion 7*a* of the insertion element 7 in front of the shoulder 19, which is arranged at the transition to the middle portion 7*b* of the insertion element 7. The lower end 17 of the lowermost tube portion 6 rests on said flange 31 when the insertion element 7 is introduced from below into the lowermost tube portion 6. The bottom surface of said flange 31 on the lower end 12 of the upper portion 7*a*of the insertion element 7 forms the upper stop for the tip body 3, or rather for the top surface of the upper stop element 10. The middle portion 7*b* and the lower portion 7*c* of the insertion element 7 comprise a smaller outside diameter d5 or d6 than the outside diameter d4 of the upper portion of the insertion element 7, the middle portion 7*b* and the lower portion 7*c* comprising the same outside diameter d5, d6 in the present exemplary embodiment. The insertion element 7 is realized in a longer manner than in FIG. 2, its overall length over all three portions 7*a*, 7*b*, 7*c* is approximately between 3 and 15 cm, preferably between 5 and 12 and in particular between 7and 10 cm. The elongated hole 13 is situated approximately in the middle of the smaller-diameter portion of the insertion element 7, i.e. approximately in the middle of the section between the flange 31 on the lowermost end 12 of the upper portion 7*a* and the lower end 32 of the insertion element 7. The middle portion 7*b*, in said exemplary embodiment, forms the region of the insertion element 7 which is engaged around by the elastomer spring element 9 and the upper stop element 10.

FIG. 4 shows a fourth preferred exemplary embodiment. In this case, the insertion element 7 is designed identically to the third exemplary embodiment in FIG. 3. The difference here is the type of fastening of the elastomer spring element 9 on the upper stop element 10 and on the end attachment 4. The connection is achieved here by a dovetail connection where an axial continuation 10*b* of the upper stop element 10 engages downward into the elastomer spring element 9 and where an upper axial continuation 8*b* on the upper end 8 of the end attachment 4 engages upward into the elastomer spring element 9 such that the respectively adjacent elements mesh into one another in a positive locking manner. The two continuations 8*b*, 10*b*, in this case, each comprise a beveled flank. In this case, a bonded connection (or as an alternative to this a materially bonded connection as a result of injecting, welding, etc.) can be provided in addition at the abutting boundary surfaces. In said fourth embodiment, at its radial inside surface, the elastomer spring element 9 is at a circumferential distance 33 from the insertion element 7. FIG. 4*e* shows a fifth preferred embodiment, this being a further alternative type of fastening of the elastomer spring element 9 on the upper stop element 10 and on the end attachment 4 compared to the fourth embodiment. A positive locking connection is also provided here, but the upper axial continuation 8*b* of the end attachment 4 and the lower axial continuation 10*b* of the upper stop element 10 do not comprise any beveled flank, but rather engage in each case in the elastomer spring element by way of a smaller-diameter neck portion, followed by a larger-diameter flange which extends by way of its top surface and its bottom surface substantially transversely to the pole longitudinal axis S and parallel to the support base. Good interlocking upward between the elastomer spring element and the upper stop element 10 or rather downward with the end attachment 4 is produced here too. Additionally, a bonded connection to the adjacent stop surfaces can also be provided here (a materially bonded connection as a result of injecting, welding, etc. is also possible here as an alternative to this).

When, for example, the elastomer spring element 9 consists of a soft material and/or comprises insufficient height in the axial direction (intentionally or non-intentionally), the lower end of the insertion element 7*c* can impact against the bottom of the central receiving opening 5*c* or rather against the circumferential step when under full load. Consequently, the damping effect ends prematurely, which can be unpleasant and disadvantageous on account of the hard impact. This can be resolved by arranging an additional damping element 34 in the receiving opening 5*c*, as is shown in FIGS. 4*h* and *i* for the case of the exemplary embodiment according to FIG. 4.

Figure 4A:
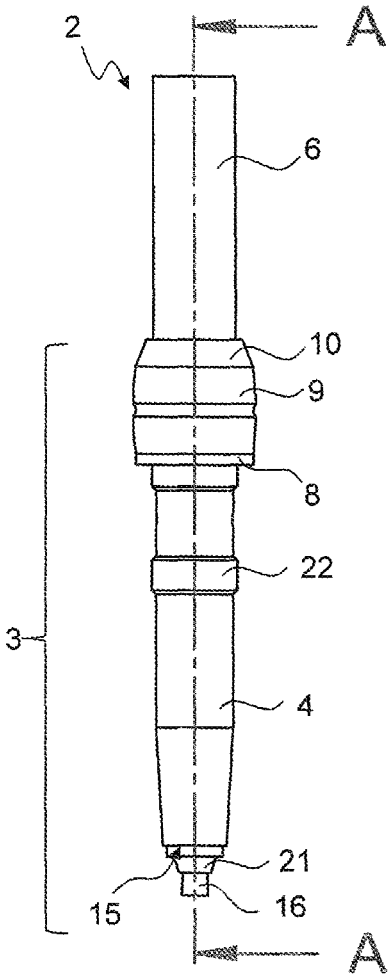
FIG. 4*a* showing a view from the front and FIG. 4*b* an axial section transversely to the direction of extension (Q) of the transverse pin through the line A-A of FIG. 4*a*.
Figure 4B:
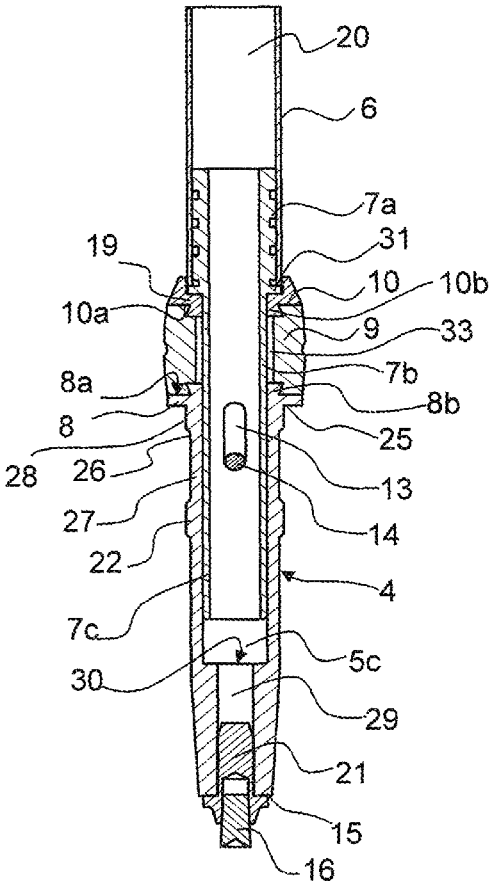
FIG. 4 shows a schematic representation of a lowermost pole tube portion with a tip body fitted from below according to a fourth preferred embodiment.
FIG. 4*c* showing a view from the side (in a view rotated by 90 degrees compared to FIG. 4*a*)
FIG. 4*d* showing an axial section along the direction of extension (Q) of the transverse pin through the line B-B of FIG. 4*c*.
FIG. 4*e* showing a schematic representation of an alternative embodiment of the fastening of the elastomer spring element on the upper stop element and on the end attachment according to a fifth preferred embodiment.
FIG. 4*f* showing a perspective representation of the lowermost pole tube portion with a tip body according to FIGS. 4*a-e* fitted from below, and FIG. 4*g* showing an exploded view of FIG. 4*f* additionally with a pole plate, and FIGS. 4*h* and *i* giving representations for said exemplary embodiment with an additional damping element in the central receiving opening of the end element.
Figure 4C:
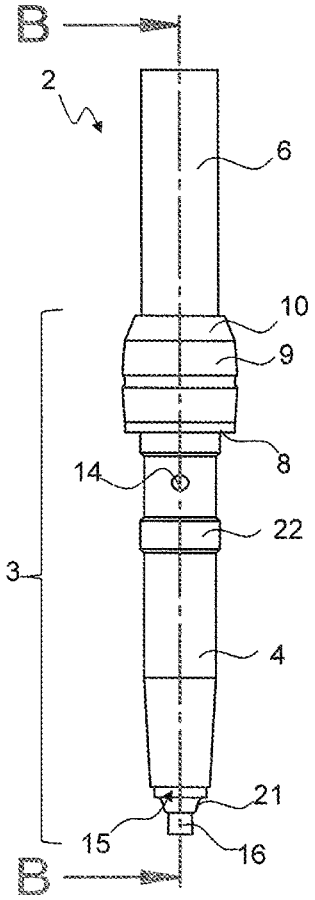
Figure 4D:
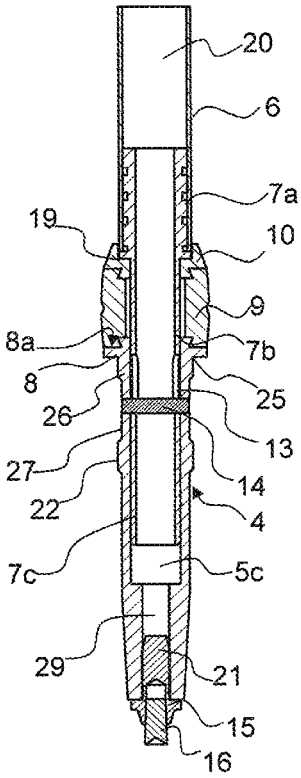
Figure 4E:
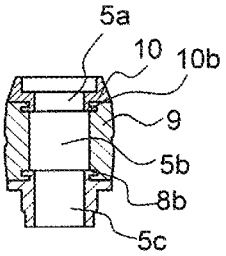
Figure 4F:
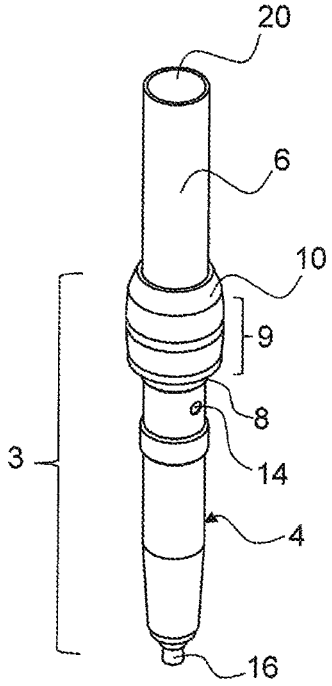
Figure 4H:
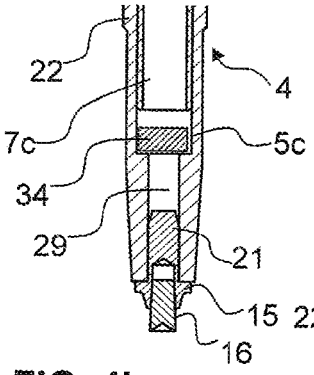

In the case of the realization according to FIG. 4*h*, said additional damping element is a small circular-cylindrical block produced from an elastomer material (analogous materials to the elastomer spring element) which is inserted into the receiving opening 5*c* or is fastened therein. The damping element 34, in this case, as shown in FIG. 4*h*, can comprise a somewhat smaller outside diameter than the inside diameter of the receiving opening 5*c*, so that for effective damping the elastomer material of the damping element is able to deflect somewhat laterally. In order to prevent the corresponding additional damping element 34 being displaced, it can, however, be pressed to a certain extent in a positive locking and/or non-positive locking manner into the receiving opening 5*c* either as a result of a corresponding design, that the outside diameter corresponds substantially to the inside diameter of the receiving opening 5*c*, or else be fastened as a result of a materially bonded connection (e.g. bonding). As an alternative to this, it possible, in the case of the exemplary embodiment shown in FIG. 4*h*, to design the damping element 34 with a downwardly directed journal which then engages in a positive locking manner in the cavity 29 and thus fixes the damping element 34 in the correct position. As an alternative to this, it is, incidentally, also quite generally possible to realize the damping element, in place of a full cylinder, in the form of a ring produced from an elastomer material (for example a simple O-ring) which then rests on the step of the bottom of the blind hole to the cavity 29.

In order to prevent the free end of the lower axial portion 7*c* damaging the damping element by way of the circumferential edge and consequently additionally ensuring optimum support on the damping element 34, a closure plug, which provides a full support surface for the top surface of the damping element 34 and prevents damage to the same, can be inserted into the hollow-cylindrical tube in said lower portion 7*c* (not shown).

Figure 4I:
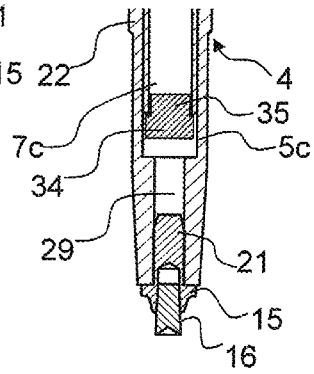
Figure 4G:
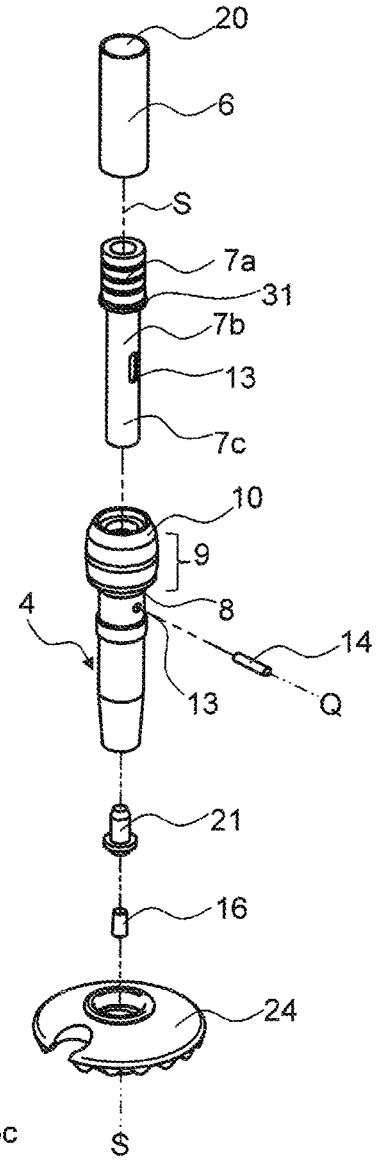

A different possible design for such a damping element 34 is shown in FIG. 4*i*. It is advantageous in particular to the mounting in the case of said exemplary embodiment for the damping element 34 to comprise an additional guide journal 35 with a somewhat smaller outside diameter which can be inserted into the lower opening of the lower portion 7*c* in a positive locking and/or non-positive locking and/or materially bonded manner. For mounting, the damping element 34 with the guide journal 35 can thus be inserted into the lower portion 7*c*, then the insertion element 7 can be inserted into the end element 4 and at the end the damping element 34 is optimally positioned and, when the damping mechanism is compressed, comes to rest on the bottom of the blind hole by way of the shoulder to the cavity 29.

The additional arrangement of a damping element 34 shown in FIG. 4*h* can be used likewise in a completely analogous manner in the case of the exemplary embodiments according to FIGS. 1-3.

In the event of the exemplary embodiment according to FIG. 1, the guide journal 35 then engages in the lowermost tube portion 6.

In the case of the exemplary embodiment according to FIG. 2, it is possible to fasten such a damping element 34 at the bottom of the insertion element 7. It is also possible to design the lowermost region of the insertion element 7, below the radial transverse pin 14 and somewhat offset therefrom, in a two-component structure, the lower region facing the cavity 5 then consisting of an elastomer material. In FIG. 2*c*, said option is shown schematically by means of a dotted line 36, the region of the insertion element 17 shown below said dotted line can consist of an elastomer material and then corresponds to the damping element 34.

| LIST OF REFERENCES | |
|---|---|
| 1 | Passage opening in 4 for 14 |
| 2 | Pole body |
| 3 | Tip body |

-continued

| LIST OF REFERENCES | |
|---|---|
| 4 | End attachment |
| 5 | Free cavity for mobility of 6a in 5c of 4, or of 7c in 5c of 4 |
| 5a | Central receiving opening in 10 |
| 5b | Central receiving opening in 9 |
| 5c | Central receiving opening in 4 |
| 6 | Lowermost tube portion of 2 |
| 6a | Lower portion of 6 |
| 7 | Insertion element |
| 7a | Upper axial portion of 7 |
| 7b | Middle axial portion of 7 |
| 7c | Lower axial portion of 7 |
| 8 | Upper end of 4 |
| 8a | Lower stop for 9 on 8 |
| 8b | Upper axial continuation of 8 |
| 9 | Elastomer spring element |
| 10 | Upper stop element |
| 10a | Upper stop for 9 on 10 |
| 10b | Lower axial continuation of 10 |
| 11 | Shoulder on 6 |
| 12 | Lower end of 7a |
| 13 | Axial elongated hole |
| 14 | Radial transverse pin |
| 15 | Lower end of 4 |
| 16 | Hard metal pin in 16 on 15 |
| 17 | Lower end of 6 |
| 18 | Peripheral structuring on 7a |
| 19 | Shoulder on 7 |
| 20 | Cavity in 6 |
| 21 | Insert on 15 for 16 |
| 22 | Threaded portion on 4 |
| 23 | Peripheral recess on 9 |
| 24 | Pole plate |
| 25 | First shoulder below 8 |
| 26 | Second shoulder below 8 |
| 27 | Region between 22 and 26 |
| 28 | Short region between 25 and 26 |
| 29 | Cavity on 15 |
| 30 | Lower end of 5c |
| 31 | Circumferential flange of 7a on 12 |
| 32 | Lower end of 7 |
| 33 | Circumferential distance on 9 |
| 34 | Damping element |
| 35 | Guide journal of 34 |
| 36 | Schematic partition line, below elastomer material |
| d1 | Radial thickness of 9 |
| d2 | Outside diameter of 6 above 11 |
| d3 | Outside diameter of 6 below 11 |
| d4 | Outside diameter of 7a |
| d5 | Outside diameter of 7b |
| d6 | Outside diameter of 7c |
| d7 | Inside diameter of 4 in 5 |
| K | Direction of force |
| L1 | Axial length of 4 |
| L2 | Axial length of 9 |

-continued

| LIST OF REFERENCES | |
|---|---|
| L3 | Axial length of 7 |
| Q | Direction of extension of 14 |
| R | Relative movement |
| S | Pole longitudinal axis |
| α | Right angle between 8a/10a and S |

The invention claimed is:

1. A pole, including a Nordic walking pole, trekking pole, ski pole, cross-country ski pole or walking pole, comprising:

a pole body having at least a lowermost tube portion with lower free end;

an insertion element which has an upper axial portion and a lower axial portion, and is fastened to the lowermost tube portion by the upper axial portion; and a tip body, wherein the tip body comprises:

a hollow end attachment having a central receiving opening for receiving at least one of the lowermost tube portion of the pole body or the lower axial portion of the insertion element, wherein the central receiving opening is a blind hole; and an outer circumferential elastic elastomer spring element:

which connects axially above an upper end of the hollow end attachment and engages around the lowermost tube portion of the pole body or around a middle axial portion of the insertion element, at least in part in the circumferential direction, and which damps an axial relative movement of at least one of the lowermost tube portion of the pole body and the insertion element relative to the end attachment when an axial force is applied;

wherein at least one of the lowermost portion of the pole body or the insertion element is mounted so as to be displaceable axially in the central receiving opening of the hollow end attachment counter a spring force of the elastic elastomer spring element.

2. A pole, including a Nordic walking pole, trekking pole, ski pole, cross-country ski pole or walking pole, comprising:

a pole body having at least a lowermost tube portion with lower free end;

an insertion element which has an upper axial portion and a lower axial portion, and is fastened to the lowermost tube portion by the upper axial portion; and a tip body, wherein the tip body comprises:

a hollow end attachment having a central receiving opening for receiving at least one of the lowermost tube portion of the pole body or the lower axial portion of the insertion element and an outer circumferential elastic elastomer spring element:

which connects axially above an upper end of the hollow end attachment and engages around the lowermost tube portion of the pole body or around a middle axial portion of the insertion element, at least in part in the circumferential direction, and which damps an axial relative movement of at least one of the lowermost tube portion of the pole body and the insertion element relative to the end attachment when an axial force is applied;

wherein at least one of the lowermost portion of the pole body or the insertion element is mounted so as to be displaceable axially in the central receiving opening of the hollow end attachment counter a spring force of the elastic elastomer spring element, wherein additionally arranged is a radial transverse pin which penetrates, in a radial manner, the hollow end attachment as well as the lowermost tube portion or the insertion element, in a direction transversely to the pole longitudinal axis, for which purpose a passage opening for the radial transverse pin is arranged in the hollow end attachment, and wherein the lowermost tube portion or the lower axial portion of the insertion element comprises at least one axial elongated hole in the respective wall for guiding the transverse pin such that the radial transverse pin is mounted so as to be axially displaceable counter the spring force of the elastic element within the boundaries of the at least one axial elongated hole when an axial force acts from above onto the pole body.

3. The pole as claimed in claim 2, wherein the tip body further comprises an upper stop element which provides an upper stop for the elastic elastomer spring element, and wherein the elastic elastomer spring element is arranged axially between a lower stop, which is arranged on the upper end of the hollow end attachment, and the upper stop.

4. The pole as claimed in claim 3, wherein the hollow end attachment, the elastic elastomer spring element and the upper stop element are integrally connected together.

5. The pole as claimed in claim 3, wherein at least one of the upper stop element or the lower stop element for the elastic elastomer spring element is realized as a surface, which extends in the radial direction, on the upper stop element or on the upper end of the hollow end attachment which extends at a substantially right angle to the longitudinal axis of the pole.

6. The pole as claimed in claim 3, wherein the hollow end attachment, the elastic elastomer spring element and the upper stop element are integrally connected together, in a hermetically sealing manner, as a result of a multi-component injection molding process, welding, bonding or combinations thereof.

7. The pole as claimed in claim 2, wherein the pole comprises at least two tube portions which can be telescoped into one another, and wherein the pole comprises an external clamping system for length adjustment or for detachably fixing the relative axial position of the at least two telescopic tube portions with respect to one another.

8. The pole as claimed in claim 2, wherein the hollow end attachment has an axial length of between 3 and 15 cm.

9. The pole as claimed in claim 2, wherein the elastic elastomer spring element has at least one of an axial length of within the range of between 0.5 and 4 cm, and a radial thickness within the range of between 0.2 and 1 cm.

10. The pole as claimed in claim 2, wherein the lowermost tube portion comprises a shoulder, at which the lowermost tube portion tapers axially downward such that the diameter of the lowermost tube portion axially below the shoulder is smaller than the diameter of the lowermost tube portion axially above the shoulder, wherein the shoulder serves as an upper stop for the tip body.

11. The pole as claimed in claim 2, wherein at least one of the upper or the lower axial portion of the insertion element is cylindrical.

12. The pole as claimed in claim 2, wherein the lower axial portion of the insertion element comprises a diameter which corresponds substantially to an inside diameter of the hollow end attachment in the central receiving opening such that the insertion element, which is guided inside the hollow end attachment, slides axially in the hollow end attachment when an axial force is applied from above onto the pole body.

13. The pole as claimed in claim 2, wherein the insertion element is received completely in the central receiving opening of the hollow end attachment, wherein the lower axial portion of the insertion element abuts against an inner wall of the hollow end attachment, and has a greater diameter than the diameter of the upper axial portion of the insertion element which is received in the lowermost tube portion, and wherein the lowermost tube portion projects into the central receiving opening of the hollow end attachment by way of its lower portion, and wherein a shoulder, which serves as a lower stop for a lower end of the lowermost tube portion, is arranged between the upper axial portion of the insertion element and the lower axial portion of the insertion element.

14. The pole as claimed in claim 2, wherein the central receiving opening is a blind hole.

15. The pole as claimed in claim 2, wherein the tip body further comprises an upper stop element which is fastened in on a shoulder on the lowermost tube portion of the pole body, or on the lower end of the upper axial portion of the insertion element and provides an upper stop for the elastic elastomer spring element, wherein the elastic elastomer spring element is arranged axially between a lower stop, which is arranged on the upper end of the hollow end attachment, and the upper stop, and wherein the elastic elastomer spring element is fastened on the upper and/or lower stop by means of a positive locking connection.

16. The pole as claimed in claim 2, wherein the at least one axial elongated hole comprises two axial elongated holes, which are situated opposite one another in the circumferential direction, in the respective wall for guiding the transverse pin such that the radial transverse pin is mounted so as to be axially displaceable counter the spring force of the elastic elastomer spring element within the boundaries of the two axial elongated holes when an axial force acts from above onto the pole body.

17. The pole as claimed in claim 2, wherein the elongated hole has a length of between 0.5 and 3 cm.

18. The pole as claimed in claim 2, wherein the elongated hole has a length of between 0.8 and 1.3 cm.

19. The pole as claimed in claim 2, wherein the axial length of the elongated hole is longer than the possible spring travel in order to prevent ejection from the elongated hole when the respective end position is achieved.

20. The pole as claimed in claim 2, further comprising at least one of:

the hollow end attachment comprises an axial length of between 7 and 10 cm;

the insertion element comprises an axial length of between 5 and 8 cm, or the insertion element is produced from metal, including aluminum, plastics material, including fiber-reinforced plastics material, or a combination of such materials.

21. The pole as claimed in claim 2, further comprising at least one of:

the elastomer spring element comprises an axial length of within the range of between 1.5 and 2 cm; or the elastomer spring element comprises a radial thickness within the range of between 0.5 and 0.7 cm.

22. The pole as claimed in claim 2, further comprising at least one of:

the hollow end attachment is formed in a closed manner at a free end facing a support base, wherein a pin serving as a pole tip in the form of an insert with a hard metal tip, is inserted from below at an end of the hollow end attachment facing a support base, and is fastened in the central receiving opening of the hollow end attachment, or a buffer or a pole plate is fastened on the hollow end attachment, wherein in the case of a pole plate being fastened on the pole, the pole plate engages around a region of the hollow end attachment in which the radial transverse pin projects through the central receiving opening.

23. The pole as claimed in claim 2, wherein the upper and/or the lower axial portion of the insertion element is realized formed in a cylindrical manner, and the upper axial portion of the insertion element comprises a peripheral structuring, in the form of radial recesses, in the form of radial incisions which are spaced apart from one another axially and are circumferential at least in part, and one of the following:

wherein the outside diameter of the upper axial portion is greater or smaller than the outside diameter of the middle axial portion, or the outside diameter of the upper axial portion is greater or smaller than the outside diameter of the lower axial portion of the insertion element.

24. A pole, including a Nordic walking pole, trekking pole, ski pole, cross-country ski pole or walking pole, comprising:

a pole body having at least a lowermost tube portion with lower free end;

an insertion element which has an upper axial portion and a lower axial portion, and is fastened to the lowermost tube portion by the upper axial portion; and a tip body, wherein the tip body comprises:

a hollow end attachment having a central receiving opening for receiving at least one of the lowermost tube portion of the pole body or the lower axial portion of the insertion element; and an outer circumferential elastic elastomer spring element:

which connects axially above an upper end of the hollow end attachment and engages around the lowermost tube portion of the pole body or around a middle axial portion of the insertion element, at least in part in the circumferential direction, and which damps an axial relative movement of at least one of the lowermost tube portion of the pole body and the insertion element relative to the end attachment when an axial force is applied;

wherein at least one of the lowermost portion of the pole body or the insertion element is mounted so as to be displaceable axially in the central receiving opening of the hollow end attachment counter a spring force of the elastic elastomer spring element, wherein an opening of the hollow end attachment at a free end facing a support base is closed, or wherein the hollow end attachment is closed at a free end facing the support base by a pin serving as a pole tip, which is inserted from below at an end of the hollow end attachment facing the support base, and/or that a buffer or a pole plate is fastened on the hollow end attachment.

25. A tip body for mounting on a pole that has a pole body with a lowermost tube portion, including for a Nordic walking pole, trekking pole, ski pole, cross-country ski pole or walking pole, the tip body comprising:

an insertion element which has an upper axial portion and a lower axial portion, and is fastenable to the lowermost tube portion by the upper axial portion; and a hollow end attachment having a central receiving opening, for receiving at least one of the lowermost tube portion or the lower axial portion of the insertion element; and an outer circumferential elastic elastomer spring element which connects axially above an upper end of the hollow end attachment and is engageable around the lowermost tube portion of the pole body or a middle axial portion of the insertion element in the circumferential direction, and damps an axial relative movement of the lowermost tube portion of the pole body when an axial force is applied;

wherein, when the tip body is mounted on the pole, at least one of the lowermost tube portion of the pole body or the insertion element, is mounted so as to be displaceable axially in the hollow end attachment counter a spring force of the elastic elastomer spring element when an axial force is applied from above onto the pole body, wherein additionally arranged is a radial transverse pin which penetrates, in a radial manner, the hollow end attachment as well as the lowermost tube portion or the insertion element, in a direction transversely to the pole longitudinal axis, for which purpose a passage opening for the radial transverse pin is arranged in the hollow end attachment, and wherein the lowermost tube portion or the lower axial portion of the insertion element comprises at least one axial elongated hole in the respective wall for guiding the transverse pin such that the radial transverse pin is mounted so as to be axially displaceable counter the spring force of the elastic element within the boundaries of the at least one axial elongated hole when an axial force acts from above onto the pole body.

26. The tip body according to claim 25 comprising an upper stop element which is fastened on a shoulder on the lowermost tube portion of the pole body or on the lower end of the upper axial portion of the insertion element and provides an upper stop for the elastomer spring element;

wherein the elastic elastomer spring element is arranged axially between a lower stop, which is arranged on the upper end of the hollow end attachment, and the upper stop.

27. A pole, including a Nordic walking pole, trekking pole, ski pole, cross-country ski pole or walking pole, comprising:

a pole body having at least a lowermost tube portion with lower free end;

an insertion element which has an upper axial portion and a lower axial portion, and is fastened to the lowermost tube portion by the upper axial portion; and a tip body, wherein the tip body comprises:

a hollow end attachment having a central receiving opening for receiving at least one of the lowermost tube portion of the pole body or the lower axial portion of the insertion element: and an outer circumferential elastic elastomer spring element:

which connects axially above an upper end of the hollow end attachment and engages around the lowermost tube portion of the pole body or around a middle axial portion of the insertion element, at least in part in the circumferential direction, and which damps an axial relative movement of at least one of the lowermost tube portion of the pole body and the insertion element relative to the end attachment when an axial force is applied;

wherein at least one of the lowermost portion of the pole body or the insertion element is mounted so as to be displaceable axially in the central receiving opening of the hollow end attachment counter a spring force of the elastic elastomer spring element, wherein the lower axial portion of the insertion element comprises a diameter which corresponds substantially to the inside diameter of the hollow end attachment in the central receiving opening such that the insertion element, which is guided inside the hollow end attachment, by means of a friction-locking connection, slides axially in the hollow end attachment when an axial force is applied from above onto the pole body.

* * * * *